United States Patent [19]

Duncan et al.

[11] Patent Number: 4,947,181

[45] Date of Patent: Aug. 7, 1990

[54] ASYMMETRICAL BICONICAL HORN ANTENNA

[75] Inventors: Kenneth W. Duncan; George S. Hardie, both of Santa Barbara, Calif.; Robert Jobsky, Amherst, Mass.; Michael J. Maybell; Steven T. Wada, both of Santa Barbara, Calif.

[73] Assignee: Raytheon Company, Lexington, Mass.

[21] Appl. No.: 285,919

[22] Filed: Dec. 19, 1988

[51] Int. Cl.[5] ..... H01Q 13/04

[52] U.S. Cl. ..... 343/773; 343/786

[58] Field of Search ..... 343/773, 829, 846, 899, 343/908, 786, 775, 729, 730, 774, 807

[56] References Cited

U.S. PATENT DOCUMENTS

| | | | |
|---|---|---|---|
| 2,416,698 | 3/1947 | King | 343/773 |
| 2,939,141 | 5/1960 | Casabona et al. | 343/786 |
| 3,116,485 | 12/1963 | Carson | 343/773 |

*Primary Examiner*—Michael Wimer

*Attorney, Agent, or Firm*—Edmund J. Walsh; Richard M. Sharkansky

[57] ABSTRACT

An improved biconical horn antenna having a broad azimuthal beamwidth and an asymmetrical elevation beam pattern. The antenna comprises two conical sections mounted against a grounded backplane with the tapered ends of the sections facing each other. The sections are of unequal size and have curved edges. The antenna is fed by a rectangular waveguide passing through the backplane between the tapered ends of the sections.

5 Claims, 3 Drawing Sheets

ASYMMETRICAL BICONICAL HORN ANTENNA

This invention was made with Government support under Contract No. N00024-86-G-3012 awarded by the Department of the Navy.

BACKGROUND OF THE INVENTION

This invention relates generally to antennas and more particularly to antenna shaping to provide a desired radiation pattern.

It is well known in the antenna art that the shape of an antenna effects both the beam pattern of the antenna and the frequency range over which the antenna operates. (Hereinafter, antennas will be described as transmitting radio frequency energy. However, one skilled in the art will realize that antennas also operate to receive radio frequency energy and the dual of every statement about transmissions holds true for antennas used to receive signals). The shape impacts such operating parameters as: the elevation and azimuthal coverage, which is measured by the directions in space where the antenna transmits signals having levels within 3 dB of the maximum level; the antenna gain; magnitude of the antenna sidelobes; and the amount of ripple in the main beam, which is measured by the amount the gain changes over the elevation and azimuthal coverage areas.

Many antenna parameters are not independent. It is, therefore, not possible to attain arbitrary values for all parameters. For example, increasing the beam coverage area might also increase the sidelobes and ripple. In actual applications, an antenna design is selected which represents a compromise between the various antenna parameters.

One application requiring special antenna design is electronic counter measure (ECM) transmissions. For instance, it is often desirable for an ECM system to transmit signals with a wide azimuthal coverage with low sidelobes and with low ripple. It might also be desirable for an antenna in an ECM system to have relatively high gain.

One antenna sometimes used for such applications is known as a biconical horn antenna. Such antennas have symmetrical upper and lower sections shaped like cones with the tapered ends of the cones facing each other. The cones making up the upper and lower sections are cut along a centerline from base to tip with the cut portions mounted against a ground plane. Signals are coupled to the antenna in one of several ways. A coaxial cable running through the center of one of the sections might have its outer conductor connected to one half of the antenna and its inner conductor connected to the other half of the antenna. Alternatively, a circular waveguide might run through one of the sections and have its opening in the region between the conical sections.

In many applications, the antenna is mounted very near the ground or, if on a ship, near the water. It would be desirable for an antenna to direct radio frequency signals into the regions above the ground or the water without directing any signals into the ground or water. If a biconical horn antenna is tilted upward, energy will be radiated above the ground or water in the regions directly in front of the antenna. However, tilting a biconical horn antenna has little impact on the elevation coverage near the sides of the antenna. The biconical horn antenna is therefore not well suited to applications where asymmetrical elevation coverage is desired.

SUMMARY OF THE INVENTION

With the foregoing background of the invention in mind, it is an object of this invention to provide an antenna with a broad azimuthal coverage.

It is further an object of this invention to provide an antenna with asymmetric elevation coverage.

It is yet a further object of this invention to provide an antenna with low sidelobes and low ripples in the main beam when operated over a wide range of frequencies.

The foregoing and other objects of this invention are achieved by an antenna comprising: two conical sections mounted against a grounded back plane with the tapered ends of the cones facing each other. The sections are of unequal size and have curved edges. The antenna is fed by a rectangular waveguide passing through the back plane.

BRIEF DESCRIPTION OF THE DRAWINGS

For a more complete understanding of this invention, reference is now made to the following description of a preferred embodiment of this invention, as illustrated in the accompanying drawings, in which.

DESCRIPTION OF THE PREFERRED EMBODIMENT

Figure 1:
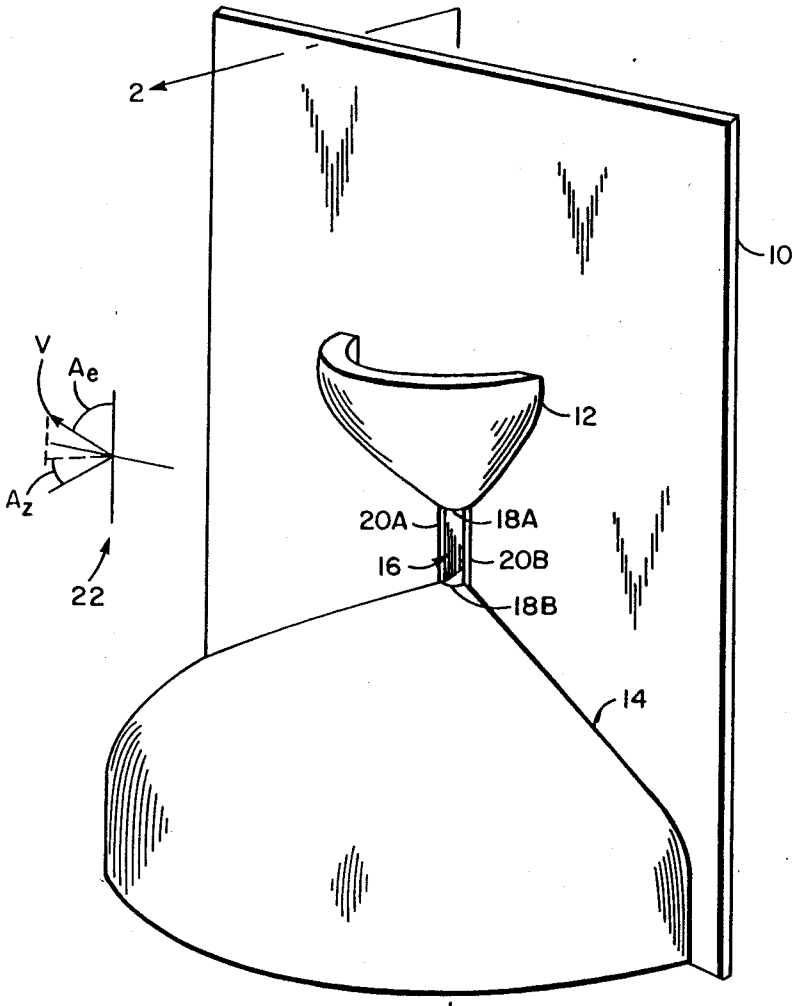
FIG. 1 is a sketch of an antenna constructed according to the present invention.

Turning now to FIG. 1, a sketch of an antenna constructed according to the present invention may be seen. The antenna is constructed of any conducting material commonly used for antennas. To facilitate further discussion, legend 22 shows a vector V having an arbitrary direction. Vector V has a direction $A_z$ measured in the azimuthal plane and an angle $A_e$ in the elevation plane.

Conical upper section 12 and conical lower section 14 are mounted against grounded back plane 10. Rectangular waveguide 16 passes through back plane 10 between the tapered ends (not numbered) of conical upper section 12 and conical lower section 14.

Waveguide 16 ends near the surface of back plane 10, but the vertical walls (not numbered) extend beyond the surface of back plane 10 to form protrusions 20A and 20B. The horizontal walls (not numbered) of waveguide 16 are flush with the surfaces of conical upper section 12 and conical lower section 14. To provide flush surfaces, the conical sections 12 and 14 do not come to a point, but terminate in flat, semi-circular matching sections 18A and 18B, respectively.

Figure 2:
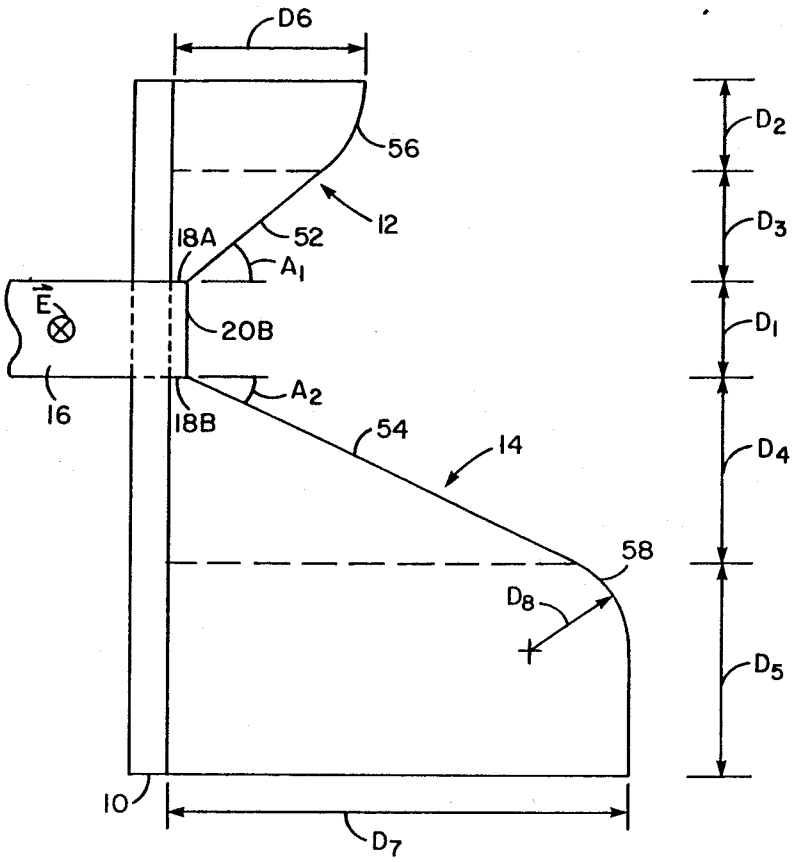
FIG. 2 is a cross-section of the antenna in FIG. 1 taken through the plane 2—2.

FIG. 2 shows that waveguide 16 is driven such that the E field is in the aziumthal plane (i.e. perpendicular to the plane of FIG. 2). Having the E field in that direction provides low side lobes in the elevation plane.

As is well known in the art, the dimensions of an antenna are determined by the frequency at which the antenna operates. Dimensions $D_1 \ldots D_7$ of the antenna are shown in FIG. 2. Table I lists the lengths of $D_1 \ldots D_7$ in wavelengths at the operating frequency. For example, the length of the vertical walls of waveguide 16 is depicted as dimension $D_1$. In Table I, $D_1$ is shown to have a length of wavelength.

TABLE I

| | |
|---|---|
| $D_1$ | 0.99 |
| $D_2$ | 1.02 |
| $D_3$ | 1.13 |
| $D_4$ | 1.94 |
| $D_5$ | 2.04 |
| $D_6$ | 1.83 |
| $D_7$ | 4.70 |
| $D_8$ | 1.02 |

Where it is desirable for the antenna to operate over a range of frequencies, a nominal operating frequency in the center of the range is selected. The dimensions in Table I would then represent wavelengths at the nominal operating frequency.

As regards other dimensions of the antenna, the horizontal dimension of waveguide 16 (not shown in FIG. 2) is approximately one-third of the vertical dimension $D_1$. The angle $A_1$ was here selected to be approximately 40° and angle $A_2$ was here selected to be approximately 26°. The protrusions 20A and 20B (FIG. 1) extend beyond the surface of back plane 10 a few hundredths of an inch.

As an example of the operation of an antenna constructed according to the present invention, an antenna fabricated according to the dimensions in Table I, yielded the characteristics in Table II. The range of values for each characteristic is due to the fact that the characteristics were measured at many frequencies in a band. As indicated in Table II, the ratio of frequencies from the low frequency end to the high frequency end equals 2.43 (i.e. greater than one octave).

TABLE II

| | |
|---|---|
| Azimuthal Halfpower Beamwidth | 160°-166° |
| Elevation Halfpower Beamwidth | 28°-39° |
| Frequency Band | 2.43:1 |
| Side Lobes | less than −30dB |
| Gain with Respect to a Linear Isotropic Source | 6dB |

The antenna transmits a beam symmetrical in the azimuthal direction. Thus, an azimuthal beamwidth of 160° corresponds to a beam extending between −80° and +80° in the azimuthal plane of the antenna. The antenna, however, is not symmetrical in the elevation direction.

Figure 3:
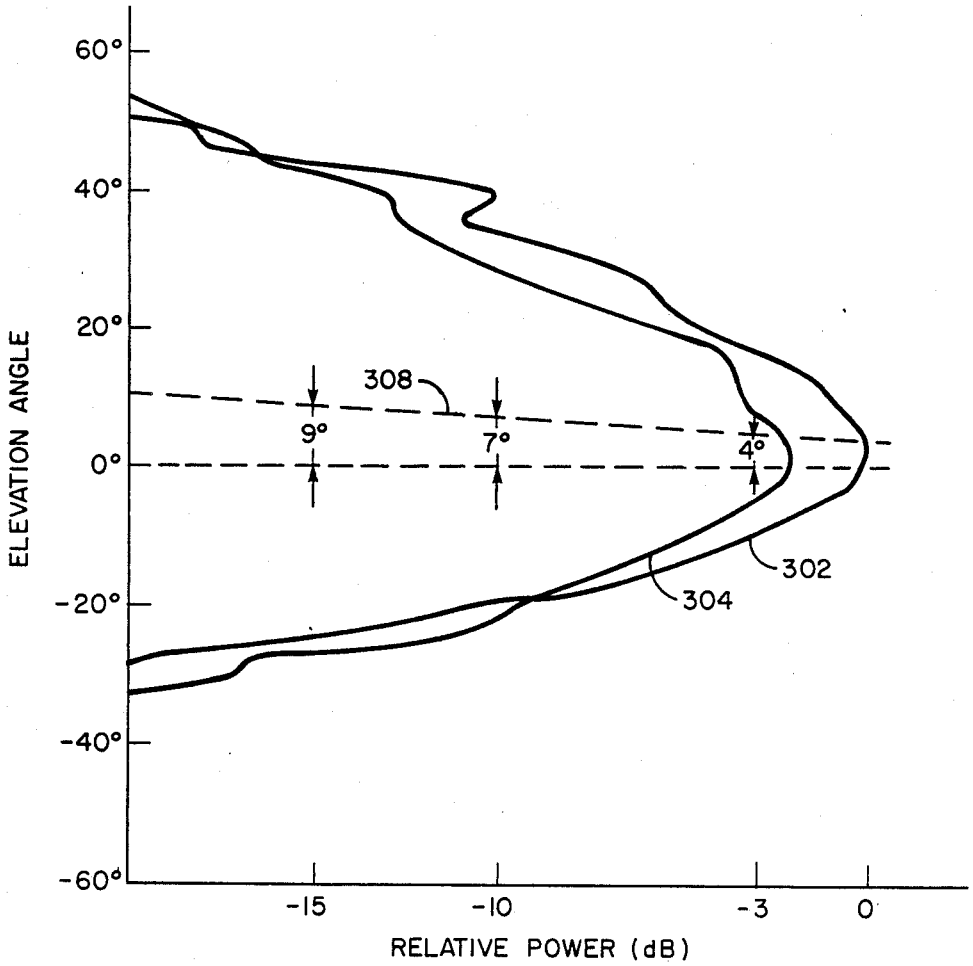
FIG. 3 is a plot of energy radiated from the antenna of FIG. 1 as a function of elevation.

FIG. 3 shows more clearly what is meant by asymmetrical elevation coverage. Curves 302 and 304 show experimental measurements of the beam pattern for an antenna constructed according to the dimensions in Table I. Line 308 shows the elevation angle at which the centroid of the beam pattern occurs. For example, for a power 3 dB below the maximum power, the centroid of the beam is 4° above the horizon. As can be seen, at lower powers the centroid of the beam is further above the horizon.

Figure 4:
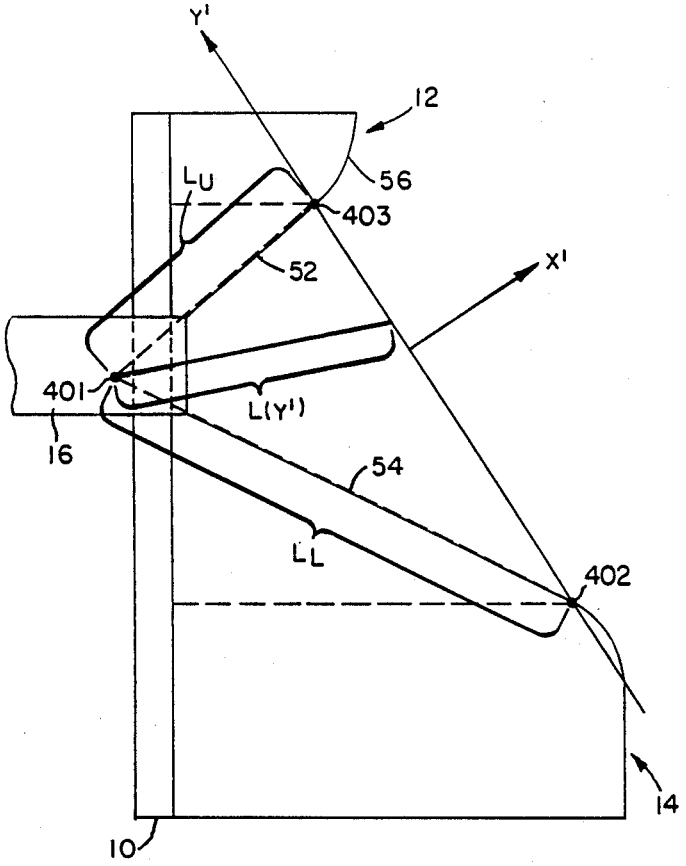
FIG. 4 is a cross-section of the antenna in FIG. 1 showing a coordinate system useful in estimating the energy radiated from the antenna as a function of elevation.

The dimensions given above for Table I represent dimensions yielding an antenna useful for a particular application. Here, the precise dimensions were selected empirically with the aid of a computer simulation. FIG. 4 shows a crosssection of the antenna with axes y' and x' superimposed on it. The y' axis is colinear with points 402 and 403. Point 402 is the transition point between the straight portion 54 and the curved portion 58 of lower section 14. Point 403 is the transition point between the straight portion 52 and curved portion 56 of the upper section 12. Point 401 is the apex of a triangle encompassing points 402 and 403 and encompassing straight portions 52 and 54.

The aperture of the antenna is along the y' axis between points 402 and 403 and has a length A. Here, point 402 corresponds to a point on the y' axis having a value of −A/2 and 403 corresponds to a point having a value of A/2.

The electric field in the aperture, E(y'), can be analytically represented as follows:

$$E(y') = -a_z\,(L_u/L(y'))\cos(\pi y'/A)\,e^{j2\pi(L_u - L(y'))/\lambda} \qquad \text{Eq. (1)}$$

where y' is a variable defining the location along the y' axis;

A is the length of the aperture;

$L_u$ is the distance between points 401 and 403;

$L_L$ is the distance between points 401 and 402;

L(y') is the distance between point 401 and a point y';

λ is the free space wavelength of a signal transmitted from the antenna; and $a_z$ is a unit vector along the Z' axis which is understood to be orthogonal to the axes x' and y' shown in FIG. 4.

Using well known techniques, the far field distribution may be calculated from the electric field in the aperture. From Eq. (1), therefore, the far field distribution of the antenna of FIG. 1 can be calculated. Here, a general purpose digital computer was programmed to compute the far field pattern using Eq. (1). The parameters A, $L_u$ and $L_L$ in the computer program were varied until the field pattern covered the desired regions.

The dimensions might be altered to provide an antenna suited for other applications. For instance, the length of protrusions 20A and 20B might be increased to provide a broader azimuthal beamwidth. However, increasing the length of protrusions 20A and 20B increases the amount of ripple in the beam. The angles $A_1$ and $A_2$ might be adjusted to alter the elevation beamwidth.

It will also be evident that many other changes and modifications may be made in the preferred embodiment without departing from the inventive concepts. For example, the antenna might be used in conjunction with a polarizer to modify the polarization of radiated signals. It is felt, therefore, that this invention should not be restricted to its disclosed embodiment, but rather should be limited only by the spirit and scope of the appended claims.

What is claimed is:

1. An antenna comprising:

(a) a backplane;

(b) an upper section having a portion shaped as a cone split along a centerline from the base of the cone to the tip, said upper section mounted to the backplane;

(c) a lower section having a portion shaped as a cone split along a centerline from the base of the cone to the tip, said lower section larger than the upper section, and said lower section mounted to the backplane along the centerline with the tip of the lower section facing the tip of the upper section; and (d) a waveguide passing through the backplane between the tip of the upper section and the tip of the lower section.

2. The antenna of claim 1 wherein the waveguide is rectangular.

3. The antenna of claim 2 wherein two walls of the waveguide protrude beyond the surface of the backplane.

4. The antenna of claim 3 wherein the two protruding walls of the waveguide are approximately three times longer than the non-protruding walls.

5. The antenna of claim 1 wherein:

(a) the upper section comprises a curved portion adjacent to its cone shaped portion; and (b) the lower section comprises a curved portion adjacent to its cone shaped portion.

* * * * *